United States Patent [19]

Hausenblas

[11] 4,318,330

[45] Mar. 9, 1982

[54] METHOD AND APPARATUS FOR THE PRECISE ALIGNMENT OF A WEAPON

[75] Inventor: Helmut Hausenblas, Kassel-Kirchditmold, Fed. Rep. of Germany

[73] Assignee: Rheinstahl Aktiengesellschaft, Essen, Fed. Rep. of Germany

[21] Appl. No.: 600,908

[22] Filed: Jul. 21, 1975

[30] Foreign Application Priority Data

Jul. 19, 1974 [DE] Fed. Rep. of Germany ..... 2434640

[51] Int. Cl.[3] ..... F41G 5/24

[52] U.S. Cl. ..... 89/41 TV

[58] Field of Search ..... 89/41 TV, 41 R, 40 B

[56] References Cited

U.S. PATENT DOCUMENTS 3,575,085 4/1971 McAdam ..... 89/41 R 3,711,638 1/1973 Davies ..... 89/41TV

*Primary Examiner*—Stephen C. Bentley

*Attorney, Agent, or Firm*—Spencer & Kaye

[57] ABSTRACT

A method and apparatus for precisely aligning a top-mounted individually stabilized weapon on an armored vehicle by means of a fire control system including an optical observation and aiming system controlled by the vehicle gunner after a target, which has been optically sighted by the vehicle commander by means of a stabilized panoramic optical device, has been taken over by the vehicle gunner in his own individually stabilized optical device. After sighting a target the vehicle commander initiates a control signal which causes the actual values of position of his panoramic optical device to be transmitted to the stabilization control of the gunner's optical device as rated values resulting in the two optical devices being aligned. Thereafter, in response to control signals generated by the gunner, the weapon is aimed at the target as seen through the gunner's optical device, the image of the target as seen by a target television camera fixedly mounted on the weapon is switched to a television monitor in front of the gunner, and then the weapon is finely aimed at the target as seen on the monitor and is fired.

6 Claims, 6 Drawing Figures

METHOD AND APPARATUS FOR THE PRECISE ALIGNMENT OF A WEAPON

BACKGROUND OF THE INVENTION

The present invention relates to a method to precisely align a top-mounted weapon in an armored combat vehicle by means of a fire control system including an optical observation and aiming system after the target has been detected by the tank commander and taken over by the gunner using individually stabilized panoramic optical devices and to an apparatus for practicing the method.

This method is particularly suited for firearms but can also be used, under certain conditions, for remote controlled weapons.

Modern armored combat vehicles must satisfy the demand for a high probability of scoring a direct hit with the first shot, and thus rapidly destroying the enemy target, e.g., a tank, in order to reduce the danger to the armored combat vehicle itself. As a further feature to augment protection of the armored vehicle, it is necessary to be able to fight the enemy from a moving armored combat vehicle since a moving vehicle, particularly when it moves in a series of irregular forward movements and directions, is much harder to hit for the enemy. As an added passive protection for the crew of the armored combat vehicle, it is necessary that they be seated as low in the vehicle as possible behind the ballistic front armor of the vehicle hull and that the weapon be placed high on the armored combat vehicle, resulting in the provision of a top-mount.

The top-mount is elevatably mounted on a supporting arm which extends upwardly from the turret roof, which is at the same level as the roof of the hull, and which, together with the lower portion of the turret, i.e., the turret cradle, can be rotated about its azimuth axis. During movement of the vehicle, shocks from the uneven roadway subject this supporting arm to certain, though slight, elastic deformations due to the mass of the top-mount which is attached to its upper end, and these deformations adversely influence the direct hit probability if the target is observed by the gunner, or the vehicle commander, through stabilized panoramic optical devices which are accommodated in the roof of the lower turret portion.

In an attempt to reduce this adverse influence on the direct hit probability, it has been proposed to permanently connect a device, including a target telescope with a target marker and a television camera, to the weapon in the top-mount and to transmit the image from this target telescope via the television camera to a monitor in front of the gunner or vehicle commander. In this case the weapon is stabilized together with this device—here called the target television camera. However, since the target television camera is accommodated near the weapon high up in the armored combat vehicle, it is in greater danger of being hit than the lower disposed panoramic optical devices for the vehicle gunner and the vehicle commander. For this reason and to reduce the space requirement, the optical portion of the target television camera has a viewing aperture with a smaller diameter, i.e., less light-transmission, than that of the panoramic optical devices. Therefore, and since for economic reasons the television transmission from the target camera to the monitor is made only in black and white, the gunner is less able to make out a target assigned to him by the commander by means of the target television camera than in his panoramic optical device which operates purely optically and thus in color. In addition, the target television camera has a smaller field of vision than the panoramic optical device which generally is also switchable to a smaller enlargement with a correspondingly larger field of vision. The latter advantages of the panoramic optical device compared to the target television camera for the target detection also remain if the panoramic optical device, for example, in order to increase its output at dusk or dawn or when the gunner can no longer look through the viewer of the optical channel of his panoramic optical device because of too heavy shocks to the vehicle, is provided with an additional television camera and is switched to television transmission to the monitor, although the picture viewed in this case is also only black and white.

In conventional turret tanks in which the above-mentioned target television camera is not provided, the panoramic optical devices serve as observation as well as firing aids. The panoramic optical devices are individually stabilized with the aid of gyro packets attached thereto. The weapon is also individually stabilized with the aid of its own gyro packet, independent of the optic stabilization. During observation, the commander and the gunner each guide their own individually stabilized panoramic optical device by means of appropriate control signals which they transmit by means of their respective steering sticks to the stabilization mechanisms for the respective optics. During this time, the alignment of the weapon is immaterial, i.e., it is pointed somewhere under its own stabilization control. In order to hit a target, the crew member involved, preferably the gunner, takes over control of movement of the weapon and aligns it with his panoramic optical device so that the weapon follows the primarily stabilized panoramic optical device. The drawback in this case is that the stabilization error which is already present for the panoramic optical device is increased by the additional follow-up error of the weapon. During the observation phase through the panoramic optical device this procedure can also be applied for a top-mounted weapon. However, conditions are different for aiming such a weapon with a target television camera which is then stabilized together with the weapon only through the panoramic optical device which is now not being used by the gunner, i.e., the gunner is now observing the target via the target television camera.

German Pat. No. 1,913,406, issued Nov. 22, 1973, discloses a fire control system for combat vehicles with a target tracking device with which the weapon can more easily be aligned by the gunner during the critical alignment phase with the aid of a signalling device and the time period between target recognition and direct-hit firing of the weapon can be shortened. This publication further indicates that the commander of an aircraft can take part in the aligning process effected by the gunner.

A target finding device attached to the weapon including an image amplifier tube or image converter tube is also known in the art, for example, see German Auslegeschrift (published patent application) No. 2,205,325, published Apr. 5, 1973.

These devices, however, are not suited for automatic target-finding for a top-mounted weapon in which the probability of a direct hit with the first shot is impeded by the elastic deformations of the supporting arm for the weapon which extends out of the top of the vehicle. That is, in contrast to a tubular weapon of the type to which the present invention is directed, with a weapon for a guided missile, as in the above-mentioned references, the elastic deformation of the supporting arm for the weapon is of no importance for hitting a target with the guided missile; rather it is important only for homing in of the missile after it has left the launching platform and has reached the field of view of the target optic.

SUMMARY OF THE INVENTION

It is now the object of the present invention to provide a method and apparatus for armored combat vehicles with top-mounted weapons which permits the gunner to quickly and dependably find and register the target and to fight it with high probability for a direct hit on the first shot.

This is basically accomplished according to the invention, by a process in which, after sighting of a target by the vehicle commander, the panoramic optical device of the gunner is moved by the vehicle commander into the position of the commander's panoramic optical device, by a push on a control button to generate a control signal, in that the actual values of the position of the commander's optical device as to elevation and azimuth are transmitted as rated values to the stabilization control of the gunner's optical device. After the gunner's optical device has taken over the target, the gunner generates a control signal, e.g., by pressing a button, to switch the image from a target television camera, which is fixed to the weapon, to his monitor, and then the gunner makes a fine adjustment in the aim of the weapon with the aid of the target television camera and fires the weapon.

It may here be advisable for the control signal initiated by the vehicle commander in order to move the gunner's panoramic optical device to simultaneously move the weapon in the direction of the commander's panoramic optical device, and the gunner's push on the button to generate the control signal to simultaneously switch the weapon to a primary stabilization condition and to directly guide the weapon with alignment signals from the steering stick of the gunner, the individually stabilized panoramic optical device of the gunner then following the movement of the weapon. It is further advisable for the target television camera to be provided, in a known manner, with an adjustable target marker which is provided in the optical portion of the target television camera and for the marker to be adjusted in a known manner, after the gunner has pushed the button, according to correction values (elevation, lead) which have been determined by the fire control computer.

In practicing the method, an apparatus is employed in which a target television camera is provided which is fixed to the weapon and each of the individually stabilized panoramic optical devices for the vehicle commander and the gunner has associated to it a monitor and a steering stick which is provided with push buttons which generate control signals. One of the push buttons, in a first position produces the image from the target television camera on the gunner's monitor, and in a second position produces the image of a television recording camera, which is included in the panoramic optical devices in addition to their purely optical channel, on the associated monitor.

According to a further feature of the invention one of the control push buttons on the steering stick is provided in the form of dual-triple switches, with a first switch portion controlling the switching of the weapon to the primary stabilization condition, a second switch portion controlling the switching of the correction values (elevation, lead) to the displaceable target marker in the target television camera and a third switch portion controlling the switching of the individually stabilized panoramic optical device to a condition so that it follows the movement of the weapon.

The advantages obtained with the present invention lie in particular in that the target is detected better and faster, the fine alignment of the weapon is more accurate and the accuracy is always assured in spite of the speed.

DETAILED DESCRIPTION OF THE PREFERRED EMBODIMENTS

Figure 1:
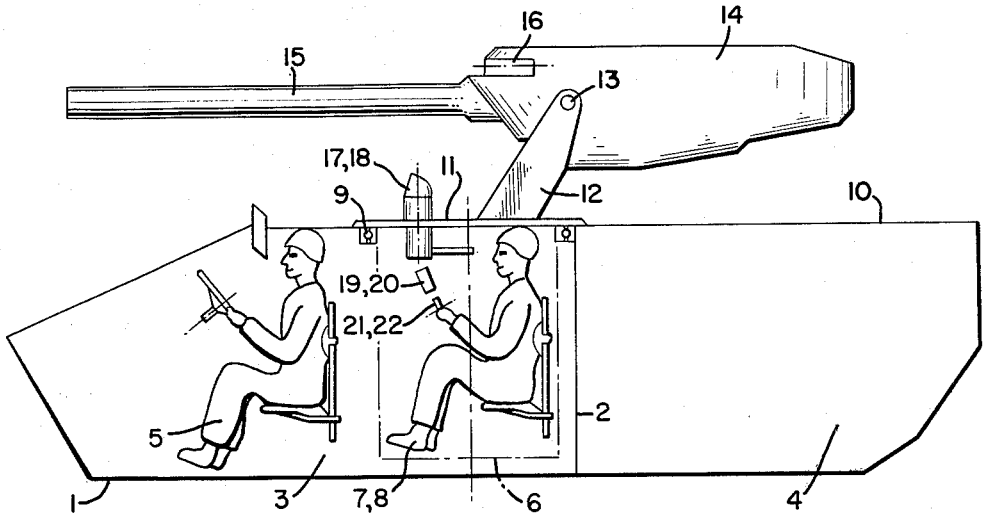
FIG. 1 is a longitudinal sectional view through the armored hull of a tank provided with a lower turret portion, a turret roof and a top-mounted weapon.

Referring now to FIG. 1, there is shown a tank having a hull 1 which is divided by an engine room partition 2 into a crew area 3 in the front of the hull and an engine room 4 in the back of the hull. In the crew area 3 of the tank the driver 5 sits in the front and behind him, in the lower turret portion 6 sit the vehicle commander 7 and the gunner 8. The lower turret portion 6 is mounted in the tank hull 1 by means of a ring bearing 9 so that the turret portion 6 can be rotated about the azimuth axis. A turret roof 11 closes off the top of the lower turret portion 6 approximately at the level of the roof 10 of the hull. Rigidly connected with the lower turret portion 6 or the turret roof 11, respectively, is a supporting arm 12 whose upper forked end is provided in a known manner with an elevation bearing 13 for a top-mount 14. A weapon 15 is built into the front portion of the top-mount 14, with the rear portion of the top-mount accommodating an ammunition magazine and an automatic loading device for the weapon (not shown). Additionally, a target television camera 16 is disposed in the front portion of the top-mount and is rigidly associated with the weapon 15. The target television camera 16 includes an objective and a series-connected television camera, a displaceable target marker being disposed in its optical portion.

Figure 2:
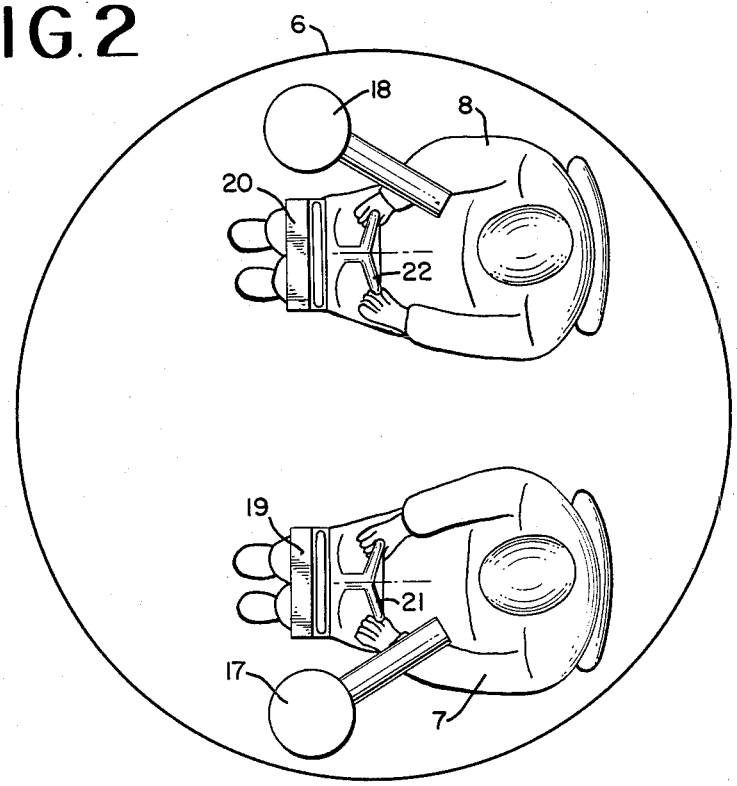
FIG. 2 is a top view of the lower turret portion of the tank according to FIG. 1 with the turret roof removed.

The target television camera 16 which is fixed to the weapon 15, because of its steady alignment with the weapon, also serves as a reference for the control or correction, respectively, of the alignment of the panoramic optical devices with the weapon. As can be seen particularly well in FIG. 2, the vehicle commander 7 and the gunner 8 each have their own individually stabilized panoramic optical devices 17 and 18, respectively, their own monitors 19 and 20, respectively, and their own steering sticks 21 and 22, respectively, which are provided with control push buttons.

Since the panoramic optical devices 17 and 18, associated with the vehicle commander 7 and the gunner 8 respectively, are each individually stabilized, both men generally observe the environment—before the gunner takes over a target—in any desired independent direction. The panoramic optical device 18 of the gunner 8 can be moved by the vehicle commander into alignment with the commander's panoramic optical device 17, in that, in response to a control signal by the vehicle commander, the actual values of the position of the commander's optical device 17 as to elevation and azimuth are transmitted to the stabilization control of the gunner's optical device as rated values. Thereafter the gunner 8, after he has taken over the target in his panoramic optical device 18, will switch the image from the target television camera 16, which is fixed to the weapon 15, to the monitor 20 and will finely aim the weapon 15 with the aid of the image from the target television camera to fire the weapon.

During the process of taking over the target where the image is generally purely optically transmitted through the panoramic optical device 18 of the gunner 8, the gunner 8 will also note the characteristic features of the area around the target which enables him, inspite of the poorer reproduction on the monitor 20 of the image from the target television camera 16, to quickly and dependably make out the target with the aid of the image from the camera 16. The vehicle commander 7 when he aligns the panoramic optical device 18 of the gunner 8 with the direction of his own panoramic optical device 17 preferably simultaneously also moves the weapon 15 into alignment with his panoramic optical device 17.

The gunner 8 continuously feeds signals into a fire control computer, in a well known manner, by pressure on his signalling button. After firing, it is the gunner's job to control the position of the hit. According to the explanations given above, he can do this better with his panoramic optical device 18 than with the target television camera 16 so that he returns to sighting via his panoramic optical device 18 immediately after firing. During the period of time when the weapon 15 is primarily stabilized to be finely aimed and fired, the individually stabilized panoramic optical device 18 of the gunner will follow the weapon. Thus when the gunner wants to return to viewing through the panoramic optical device 18 after firing, the panoramic optical device 18 will be directed toward the target even if it is a moving target.

Figure 3A:
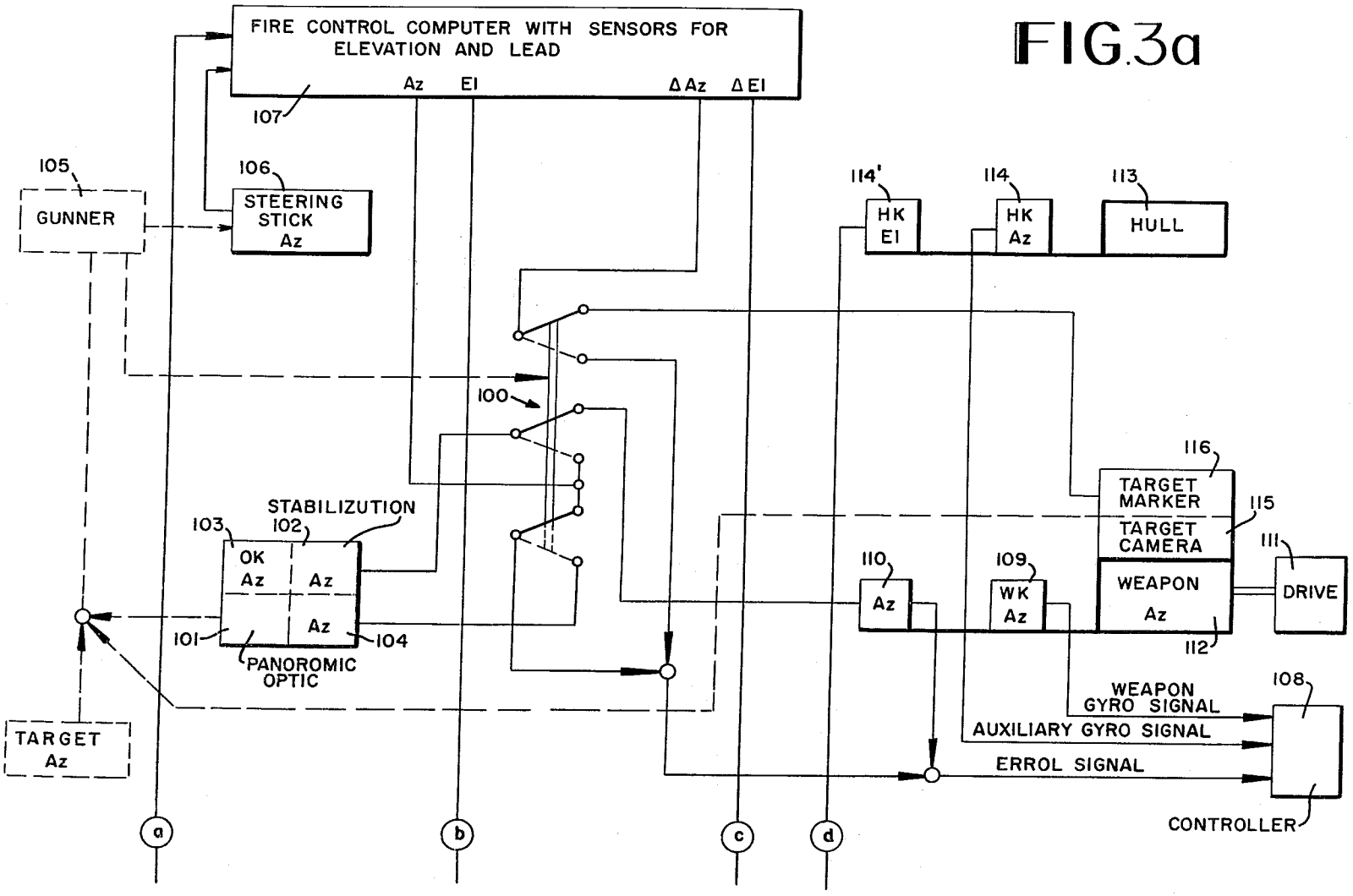
FIGS. 3*a* and 3*b* together are a signal flow plan for a switching device for carrying out the method of the present invention, the relationship between the two figures being identified by encircled small letters.

The signal flow plan for the azimuth control signals in FIG. 3*a* and the elevation control signals (FIG. 3*b*) shows all electrical signals with solid lines and all nonelectrical signals (optical signals, manual signals and the like) in dashed lines. During target finding by the gunner 105 (8 of previous figures), a dual-triple pole switch 100—100′, respectively, is in the position shown with dashed lines. In this position of the switch 100—100′ the gunner's panoramic optical device 18 (101 and 101′ in FIGS. 3*a* and 3*b*), is primarily stabilized as to azimuth and elevation through its own stabilization arrangement 102 and 102′, respectively, with the aid of gyro packets 103 and 103′, respectively, which are attached to the panoramic optical device 101—101′. The stabilization arrangements 102 and 102′ follow the alignment or steering signals which the gunner 105 transmits through his steering stick 22 (shown as separate azimuth and elevation steering sticks 106 or 106′, respectively) to the fire control computer 107 and the center portion or pole of each of the triple pole switches 100 and 101′, respectively, to the stabilization arrangements 102 and 102′, respectively. In this position of the dual switch 100—100′, i.e., the position shown in dashed lines, the weapon 112—112′ (15 of previous figures) is not primarily stabilized but rather follows the movement of the optical device 101—101′. In order to accomplish this, controllers 108 and 108′, respectively, of the weapon stabilization arrangement receive their rated values from azimuth and elevation measuring devices 104 and 104′, respectively, which are mounted on the optical device 101—101′, through the lower portion or pole of each of the triple pole switches 100 and 100′, respectively, and then processes these rated value signals together with the information from respective weapon gyros 109 and 109′, respectively, and from respective weapon azimuth and elevation measuring devices 110 and 110′, respectively, and influences the setting drives 111 and 111′, respectively, of the weapon 112—112′. In order to obtain a better quality stabilization, the controllers 108 and 108′ of the weapon stabilization arrangement may also receive the signals from auxiliary gyros 114 and 114′, respectively, which are mounted in the hull 113 of the tank. For the transfer of the target from the commander 7 to the gunner 8 (105) the commander overcontrols the signals at the steering stick 106, 106′, of the gunner, in a known manner, and thus moves the panoramic optical device 101—101′ of the gunner 105 and the weapon 112—112′ into the desired direction, whereupon the gunner 105 takes over the target in his panoramic optical device 101—101′.

Figure 3B:
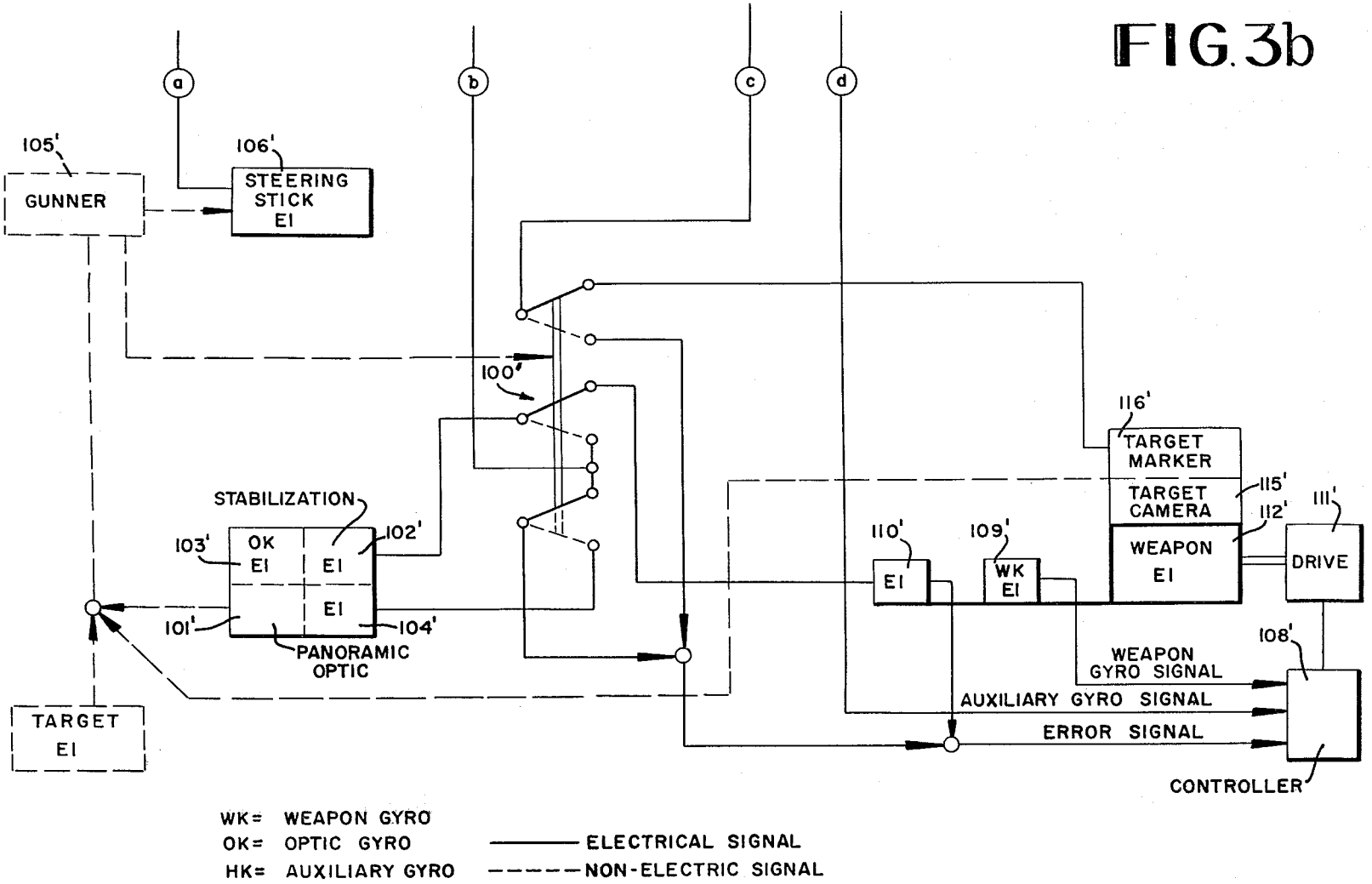
Figure 4:
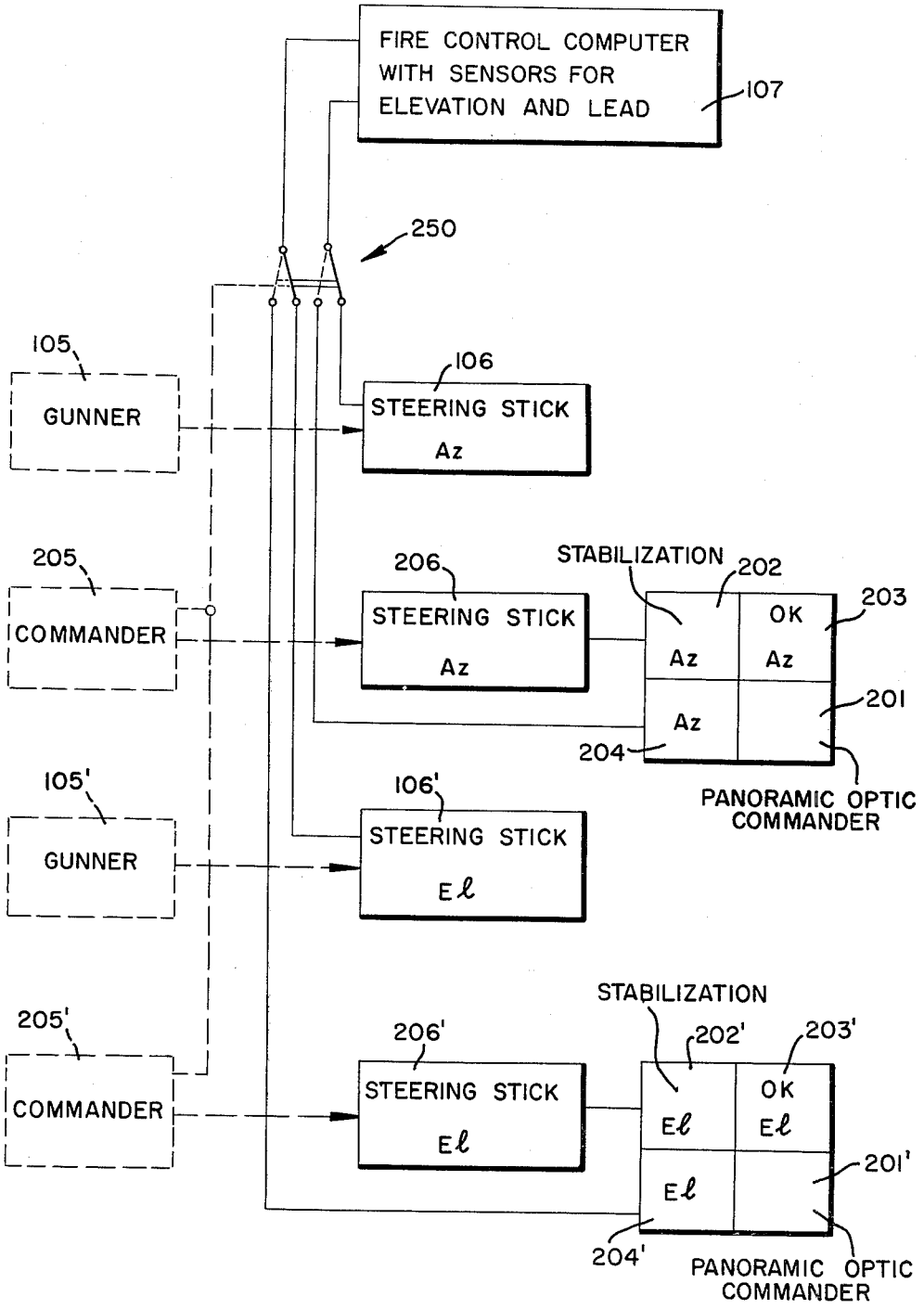
FIG. 4 is a signal flow diagram, including a portion of the signal flow diagram of FIGS. 3*a* and 3*b*, illustrating the manner in which the panoramic optical device of the gunner and the weapon are caused to follow the movement of the panoramic optical device of the vehicle commander.

The manner in which the panoramic optical device of the gunner 105 and the weapon 112 are caused to follow the movement of the panoramic optical device of the vehicle commander 205 is shown in FIG. 4 which includes a portion of FIGS. 3*a* and 3*b* and additionally includes blocks for the commander's steering stick 206 and 206′, his panoramic optical device 201, 201′ together with the corresponding stabilization arrangements 202, 202′, the gyro packets 203, 203′ and the measuring devices 204, 204′ therefor, and a further switch 250 which is controlled by a push button on the commander's steering stick.

In operation, if the commander 205 has detected a desirable target in his own individually stabilized panoramic optical device 201, 201′, he then switches the switch 250 from the fully drawn to the dashed position (the dashed line indicating a manual signal from 205 to 250) so that the fire guidance computer 107 receives, instead of the alignment signals (for azimuth or elevation, respectively) obtained from the steering stick 106, 106′ of the gunner, the aligning signals from the panoramic optical device 201, 201′ of the commander via the measuring devices 204, 204′ as rated values.

The fire guidance computer 107 then transmits these rated values in the manner described in connection with FIGS. 3*a* and 3*b* to the stabilization devices 102, 102′ of the panoramic optical device 101, 101′ of the gunner 105 and to the stabilization device 108, 108′ of the weapon 112, 112′ so that panoramic optical device 101, 101′ and weapon 112, 112' are turned in the direction of the panoramic optical device 201, 201' of the commander. After the panoramic optical device 101, 101' of the gunner 105 and the weapon 112, 112' are aligned with the commander's panoramic optical device, the switch 250 is returned to the fully drawn position shown in FIG. 4 whereby movement of the weapon and of the gunner's panoramic optical device 101, 101' is again under the control of the gunner 105 via his steering stick 106, 106'.

In principle, after the gunner has taken over the target in his panoramic optical device and has finely aimed the weapon 112—112', he can now fire his shot, for which the fire control computer 107 additionally transmits the required correction values for elevation and lead to the inputs of the controllers 108, 108', respectively, of the weapon stabilization via the upper portion or pole of each of the triple pole switches 100 and 101', respectively. However, due to the elastic deformation of the supporting arm 12 (FIG. 1) for the top mount 14, the probability of scoring a direct hit with the first shot is not very great in this process so that it is considered only as an alternative solution.

In order to increase the probability of scoring a direct hit with the first shot, according to the invention, the gunner 105, after he has taken over the target in his panoramic optical device 101—101', switches the dual-triple pole switch 100,100', into the position shown in solid lines in FIGS. 3*a* and 3*b* by pushing on a button (not shown) mounted on his steering stick. In this position of the dual switch 100—100', the weapon 112—112' now is primarily stabilized by means of its gyros 109, 109', and follows directly the aligning signals initiated by the gunner 105 via his steering stick 106—106' and transmitted to the controllers 108—108', respectively, of the weapon stabilization via the fire control computer 7 and the lower portion or pole of the triple pole switches 100,100', respectively. In this condition, the gunner 105 uses the target television camera 115—115' (6 of FIG. 1) to finely aim the weapon to which the television camera is attached, after he has switched the image from the target television camera to his monitor 20 (FIG. 2), by pressing a button (not shown) on his steering stick 22 (106—106'), where now a target marker 116—116' in the optical portion of the target television camera 115—115', receives the correction values (elevation, lead) from the fire control computer 107 through the upper portion or pole of each of the triple pole switches 100,100', respectively, and is displaced accordingly. The stabilization arrangement 102, 102' of the panoramic optical device 101—101', now receives signals corresponding to the position of the weapon 112—112' from the azimuth and elevation sensing or measuring devices 110 and 110', respectively, via the center portion or pole of each of the triple pole switches 100 and 100', respectively, as a rated value and thus follows the weapon.

To control the hit position, the gunner 105 switches the dual-triple pole switch 100—100', back to its starting position so that he can observe through the now again primarily stabilized panoramic optical device 101—101'. Since this optical device followed the weapon during firing, this switching back can be effected without any interfering movements of the panoramic optical device which would interfere with the observation of the position of the hit. At this time as during the earlier take-over of the target, the gunner can use, if desired or necessary, the target, television transmission made by a further television camera (FIG. 5) which is built into the panoramic optical device and whose output is transmitted to his monitor instead of using the purely optical channel of his panoramic optica device. During the observation of the position of the hit this has the advantage that the gunner need not change his direction of view from the monitor image of the target television camera to the viewing aperture of his panoramic optical device, but he must then be satisfied with the black and white television picture.

Figure 5:
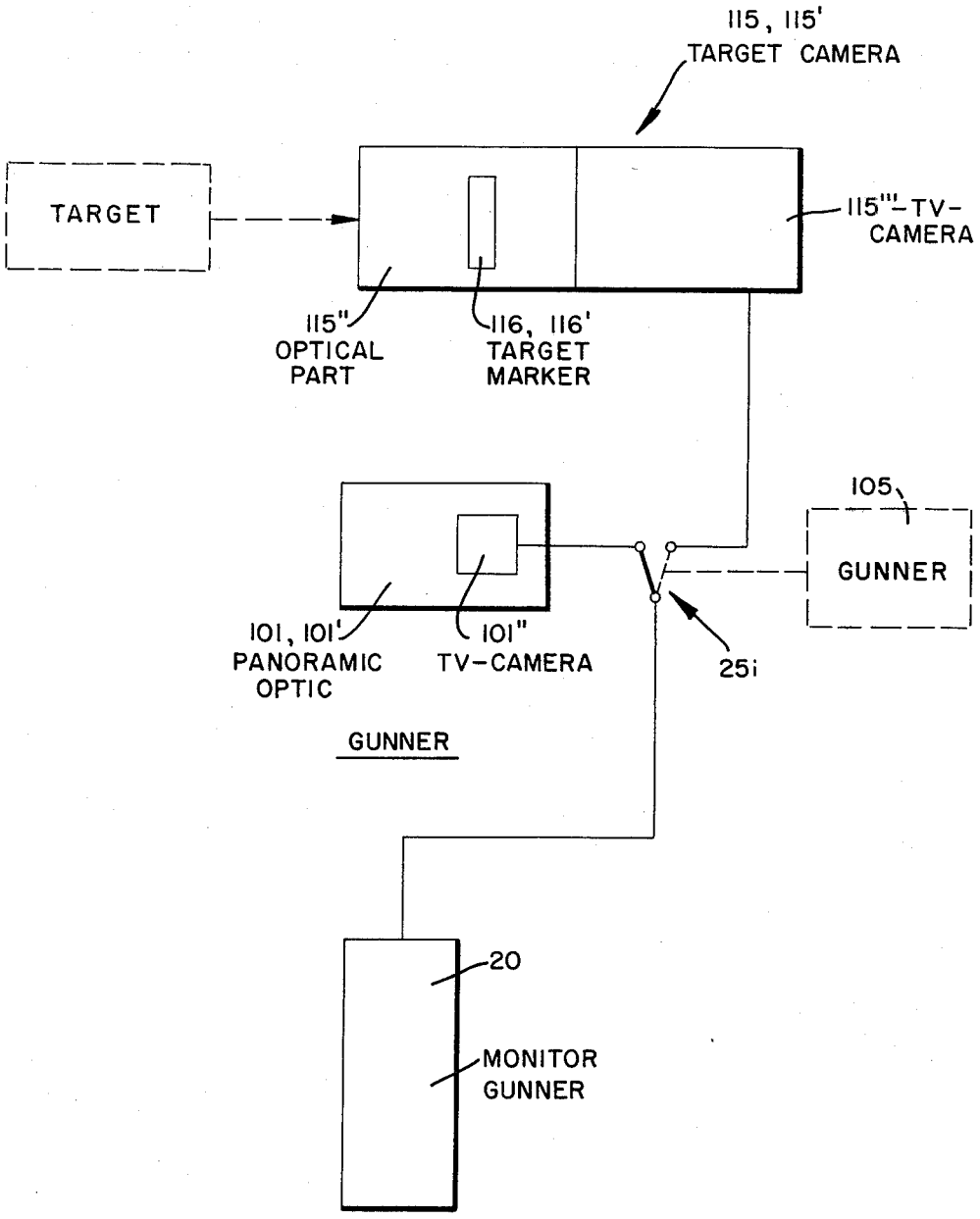
FIG. 5 is a signal flow diagram for switching the monitor of the gunner from the further television camera built into the panoramic optical device of the gunner to the target television camera mounted on the weapon.

The above-mentioned switching of the monitor of the gunner 105 is effected, according to FIG. 5, by means of a switch 251 which is mounted on the steering stick of the gunner and which is manually actuated by the gunner (dashed signal line). In the fully drawn position of switch 251 output signals from the television camera 101'' which is built into the panoramic optical device or telescope 101, 101' of the gunner are switched to the monitor 20. In the dashed position of switch 251, monitor 20 receives the picture signals from the television camera 115''', which is disposed in the target television camera 115, 115' behind its optical portion 115''. With this position of the switch 251, the target marker 116, 116' disposed in the optical portion 115'' of the target television camera 115, 115' is also transmitted to the monitor 20.

It will be understood that the above description of the present invention is susceptible to various modifications, changes and adaptations, and the same are intended to be comprehended within the meaning and range of equivalents of the appended claims.

I claim:

1. A method for precisely aligning a top-mounted individually stabilized weapon on an armored vehicle by means of a firing control system including an optical observation and aiming system controlled by the vehicle gunner after a target has been optically sighted by the vehicle commander by means of a stabilized panoramic optical device, the vehicle being additionally provided with an individually stabilized panoramic optical device for the vehicle gunner, a target television camera fixedly mounted on the weapon for movement therewith; and a television monitor for the gunner; said method comprising the steps of: in response to a control signal initiated by the vehicle commander, aligning the panoramic optical device of the gunner with the panoramic optical device of the vehicle commander by causing the actual values of the position of the commander's optical device as to the elevation and azimuth to be transmitted to the stabilization control of the gunner's optical device as rated values; thereafter, in response to control signals generated by the gunner, aiming the weapon at the target as seen through the panoramic optical device of the gunner by causing the weapon to follow the movement of the panoramic optical device of the gunner, switching the image of the target as detected by the target television camera to the television monitor, finely adjusting the aim of the weapon at the target utilizing the image on the monitor by switching stabilization control of the weapon to a primary stabilization condition and the stabilization control of the panoramic optical device of the gunner to a condition wherein it follows the movement of the weapon, and primarily moving the weapon to the desired position in response to said control signals, thereby causing the corresponding movement of the panoramic optical device, and then firing the weapon.

2. A method as defined in claim 1 said step of aligning the panoramic optical device of the gunner with the panoramic optical device of the vehicle commander simultaneously causes the weapon to follow the movement of the panoramic optical device of the gunner.

3. A method as defined in claim 1 wherein the television target camera is provided with a displaceable target marker which is disposed in the optical portion of said camera and said fire control system includes a fire control computer; further comprising: in response to a control signal generated by the gunner, changing the position of the target marker according to correction values for elevation and lead as determined by the fire control computer.

4. A method as defined in claim 1 further comprising the step of: just prior to said step of firing switching back to the stabilization control condition wherein the panoramic optical device of the gunner is primarily stabilized by control signals generated by the gunner and the movement of the weapon follows the movement of the panoramic optical device of the gunner.

5. In an armored vehicle having a top-mounted individually stabilized weapon, and a firing control system, including an optical observation and aiming system and a firing control computer, said optical observation and aiming system including individually stabilized panoramic optical devices for the vehicle commander and for the vehicle gunner, a separate steering stick means for the vehicle commander and for the vehicle gunner for generating steering movement control signals; controllable means for connecting the output of the respective steering stick means to the stabilization control of the associated said panoramic optical device to cause the panoramic optical devices to move in response to the associated said control signals, and for causing the movement of said weapon, to follow the movement of said panoramic optical device for the gunner; the improvement comprising: a target television camera fixedly mounted on said top-mount of said weapon, for movement therewith; a television monitor for at least said gunner; a further television camera disposed in said panoramic optical means of at least said gunner; a plurality of control push buttons on at least said steering stick means of said gunner; means responsive to the pushing of one of said plurality of push buttons for selectively switching either the image of said target television camera or said further television camera to said monitor; and said controllable means includes switch means for disconnecting the output of the said steering stick means for the gunner from the stabilization control of the associated panoramic optical device and connecting same to the stabilization control of said weapon to cause said weapon to move in response to said control signals, and for causing said panoramic optical device to follow the movement of said weapon.

6. The apparatus as defined in claim 5 further comprising a displaceable target marker in the optical portion of said target television camera; wherein the output of said steering stick means is connected to said firing control computer which produces the movement control signals for azimuth and elevation; and wherein said switch means is one of said plurality of control push buttons on said steering stick means of the gunner and comprises a dual-triple pole switch with one of said triple pole switches being in the signal path for azimuth control of said weapon and said panoramic optical device of the gunner and the other triple pole switch being in the signal path for elevation control of said weapon and said panoramic optical device of the gunner, each of said triple pole switches having a first position wherein the input of said stabilization control of said optical device of the gunner is connected to a movement sensor mounted on said weapon, the input of said stabilization control of said weapon is connected to the associated movement control signal output of said firing control computer and said displaceable target marker is connected to a correction value output of said firing control computer, respectively, and a second position wherein said input of said stabilization control fo said optical device of the gunner is connected to the associated movement control signal output of said firing control computer, said input of said stabilization control of said weapon is connected to a movement sensor mounted on said optical device of the gunner and said displaceable target marker is disconnected from said firing control computer, respectively.

* * * * *